US006960103B2

(12) United States Patent
Tokunaga

(10) Patent No.: US 6,960,103 B2
(45) Date of Patent: Nov. 1, 2005

(54) CONNECTOR TO BE MOUNTED TO A BOARD AND GROUND STRUCTURE OF THE CONNECTOR

(75) Inventor: Takashi Tokunaga, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 10/810,710

(22) Filed: Mar. 29, 2004

(65) Prior Publication Data

US 2005/0215121 A1 Sep. 29, 2005

(51) Int. Cl.[7] ..... H01R 13/648
(52) U.S. Cl. ..... 439/608; 439/108
(58) Field of Search ..... 439/608, 108, 439/101, 607, 609

(56) References Cited

U.S. PATENT DOCUMENTS

| | | | | |
|---|---|---|---|---|
| 3,432,801 | A * | 3/1969 | Ruotolo | 439/731 |
| 3,587,028 | A * | 6/1971 | Uberbacher | 439/49 |
| 4,571,014 | A * | 2/1986 | Robin et al. | 439/108 |
| 4,611,867 | A * | 9/1986 | Ichimura et al. | 439/101 |
| 6,123,584 | A * | 9/2000 | Van Koetsem et al. | 439/608 |
| 6,428,358 | B1 * | 8/2002 | Figueroa et al. | 439/608 |
| 6,443,745 | B1 * | 9/2002 | Ellis et al. | 439/101 |
| 6,500,029 | B2 * | 12/2002 | Nitta | 439/608 |
| 6,503,108 | B1 * | 1/2003 | Kikuchi et al. | 439/680 |
| 6,572,409 | B2 * | 6/2003 | Nitta et al. | 439/608 |
| 6,743,057 | B2 * | 6/2004 | Davis et al. | 439/701 |
| 6,764,341 | B2 * | 7/2004 | Lappoehn | 439/608 |

FOREIGN PATENT DOCUMENTS

JP 200233162 1/2002

* cited by examiner

*Primary Examiner*—Gary Paumen
(74) *Attorney, Agent, or Firm*—Baker Botts L.L.P.

(57) ABSTRACT

In a connector mounted on a board having a number of through holes, first and second housing are disposed on opposite surfaces of the board. A conductive contact is inserted through the through holes, respectively, and held by the first and the second housings. The contact has first and second contacting portions which are formed at opposite ends thereof and protrude from the first and the second housings, respectively. A first ground is held by the first housing and surrounds the first contacting portion. A second ground is held by the second housing and surrounds the second contacting portion. The first ground has a plurality of terminal portions protruding from the first housing towards the board and arranged in a first staggered pattern. The second ground has a plurality of terminal portions protruding from the second housing towards the board and arranged in a second staggered pattern. The terminal portions are inserted into the through holes, respectively.

13 Claims, 7 Drawing Sheets

CONNECTOR TO BE MOUNTED TO A BOARD AND GROUND STRUCTURE OF THE CONNECTOR

BACKGROUND OF THE INVENTION

This invention relates to a connector to be mounted to a board and a ground structure of the connector.

A connector of the type is disclosed, for example, in Japanese Patent Application Publication (JP-A) No. 2002-33162. The connector is adapted to be mounted to a board, such as a circuit board having a number of through holes. The connector comprises a pair of insulating housings disposed on opposite surfaces of the board and a plurality of conductive contacts inserted through the through holes and held by the housings. Each of the contacts has opposite ends protruding from the housings and serving as contacting portions. Each of the housings holds a conductive ground adjacent to the contacting portions of the contacts. The ground is expected to exhibit an electromagnetic shielding effect.

Each of the grounds has a plurality of terminal portions protruding from the housing towards the board and inserted into the through holes. The terminal portions of these ground plates are inserted from opposite sides of the board into respective common through holes and brought into contact with each other to achieve electrical connection therebetween.

However, in such a structure in which the terminal portions of the ground plates are contacted with each other within each single through hole, the board is inevitably increased in thickness. This is because, if the board is reduced in thickness, the through hole is short in length or depth so that it is difficult to bring the terminal portions into contact with each other within the through hole. Therefore, the board is increased in thickness and a whole of the connector including the board is increased in size.

SUMMARY OF THE INVENTION

It is therefore an object of the present invention to provide a connector to be mounted to a board, which exhibits an excellent electromagnetic shielding effect even if a board is reduced in thickness.

It is another object of the present invention to provide a connector to be mounted to a board, which can reliably be held on the board even if the board is reduced in thickness.

It is still another object of the present invention to provide a ground structure which is expected to exhibit a sufficient electromagnetic shielding effect even if the board is reduced in thickness.

Other objects of the present invention will become clear as the description proceeds.

According to an aspect of the present invention, there is provided a connector adapted to be mounted to a board, the connector comprising an insulating housing disposed on one surface of the board, a conductive contact held by the housing, the contact having a contacting portion protruding from the housing towards a side opposite to the board, and a conductive ground held by the housing and surrounding the contacting portion, the ground having a plurality of terminal portions protruding from the housing towards the board and arranged in a staggered pattern.

According to another aspect of the present invention, there is provided a connector mounted on a board having a number of through holes, the connector comprising an insulating first housing disposed on one surface of the board, an insulating second housing disposed on the other surface of the board opposite to the one surface, a conductive contact inserted through the through holes, respectively, and held by the first and the second housings, the contact having first and second contacting portions which are formed at opposite ends of the contact and protrude from the first and the second housings, respectively, a conductive first ground held by the first housing and surrounding the first contacting portion, and a conductive second ground held by the second housing and surrounding the second contacting portion, the first ground having a plurality of terminal portions protruding from the first housing towards the board and arranged in a first staggered pattern, the second ground having a plurality of terminal portions protruding from the second housing towards the board and arranged in a second staggered pattern, the terminal portions being inserted into the through holes, respectively.

According to still another aspect of the present invention, there is provided a ground structure of a connector to be mounted to a board, the connector having a first half portion mounted on a first surface of the board and a second half portion mounted on a second surface of the board opposite to the first surface, the first half portion being adapted to be engaged with and disengaged from a first mating connector, the second half portion being adapted to be engaged with and disengaged from a second mating connector, each of the first and the second half portions comprising a housing, a plurality of vertical ground plates held by the housing, and a plurality of horizontal ground plates held by the housing and intersecting with the vertical ground plates in a lattice fashion, the vertical and the horizontal ground plates having a plurality of terminal portions press-fitted into a plurality of through holes formed on the boards to be arranged in a staggered pattern, the first and the second half portions being provided with a plurality of signal contacts inserted through a plurality of through holes formed on the board, at least a part of the signal contacts being surrounded by the ground plates.

DESCRIPTION OF PREFERRED EMBODIMENTS

Figure 1:
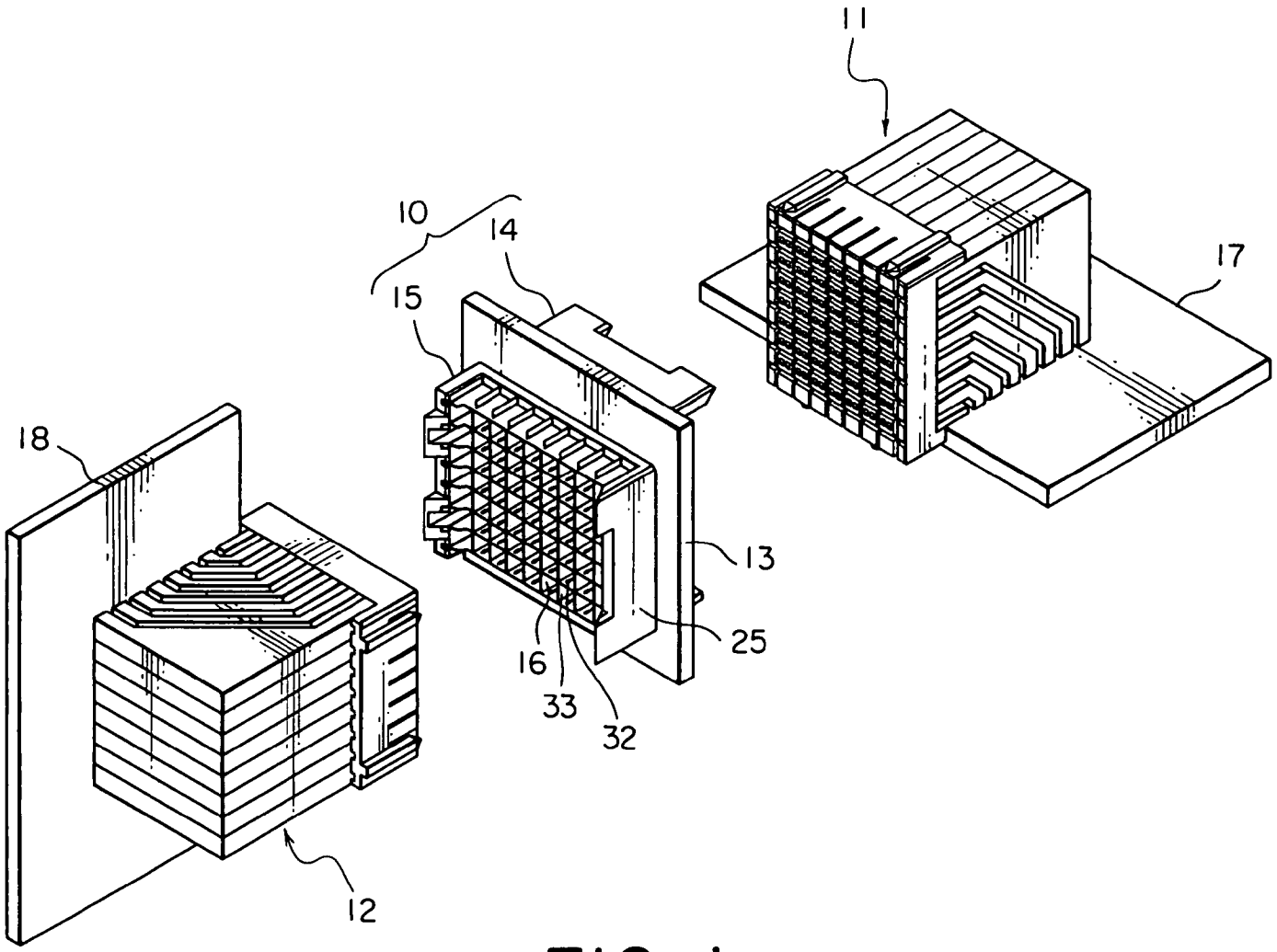
FIG. 1 is a perspective view of a receptacle connector as a connector according to one embodiment of the present invention together with a board and two plug connectors in the state before connection.

Referring to FIG. 1, description will be made of a receptacle connector 10 as a connector according to one embodiment of the present invention and first and second plug connectors 11 and 12 to be connected to the receptacle connector 11 and 12.

The receptacle connector 10 comprises a board 13 called a mid-plane, a first half portion 14 disposed on one surface or a first surface of the board 13, a second half portion 15 disposed on the other surface or a second surface of the board 13 opposite to the first surface, and several tens signal contacts 16 used in common in the first and the second half portions 14 and 15.

The first plug connector 11 is mounted to a board 17 placed in a horizontal direction and is adapted to be engaged with and disengaged from the first half portion 14 of the receptacle connector 10. The second plug connector 12 is mounted to a board 18 placed in a vertical direction and is adapted to be engaged with and disengaged from the second half portion 15 of the receptacle connector 10.

Figure 2:
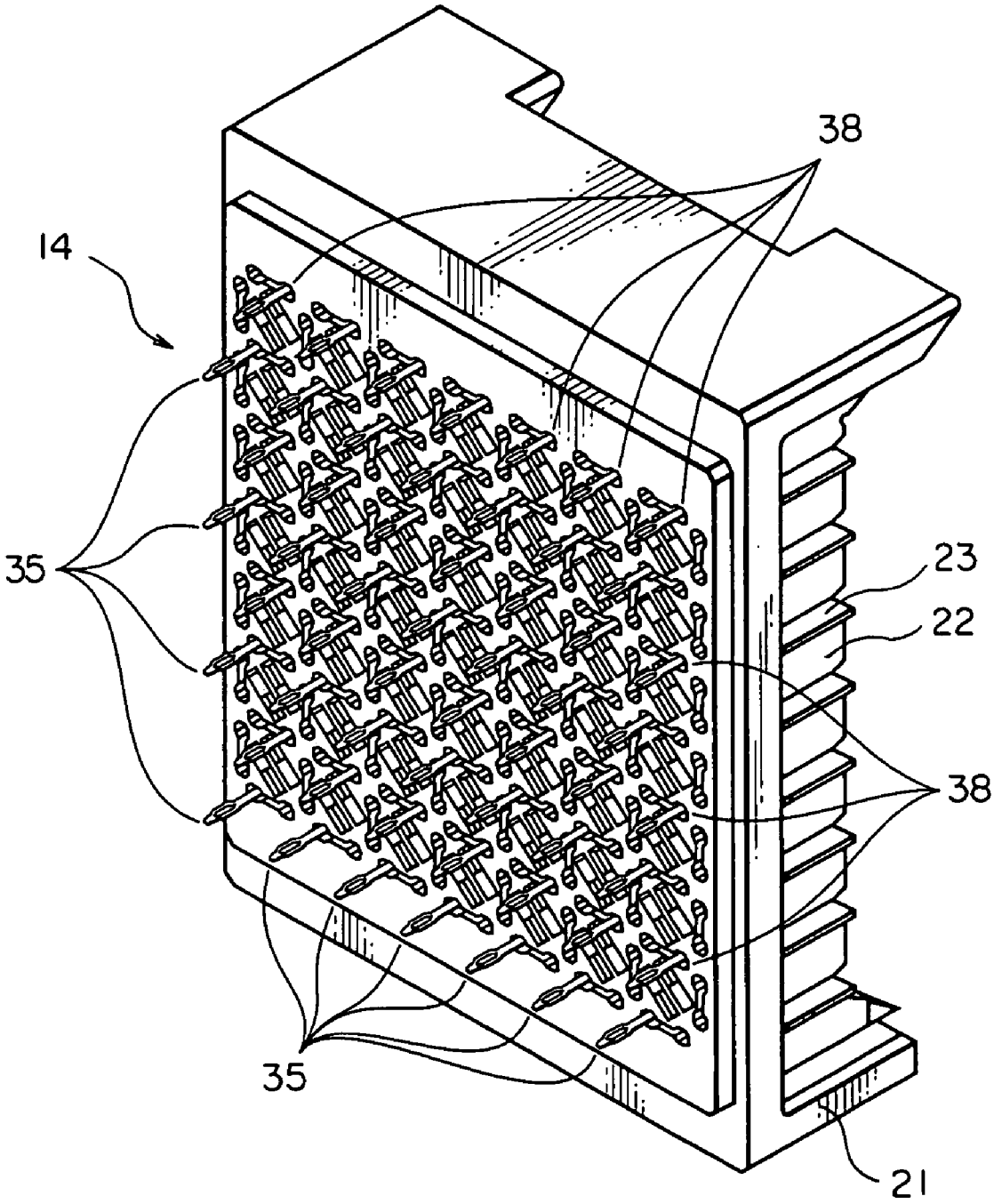
FIG. 2 is a perspective view of a part of the receptacle connector illustrated in FIG. 1.
Figure 3A:
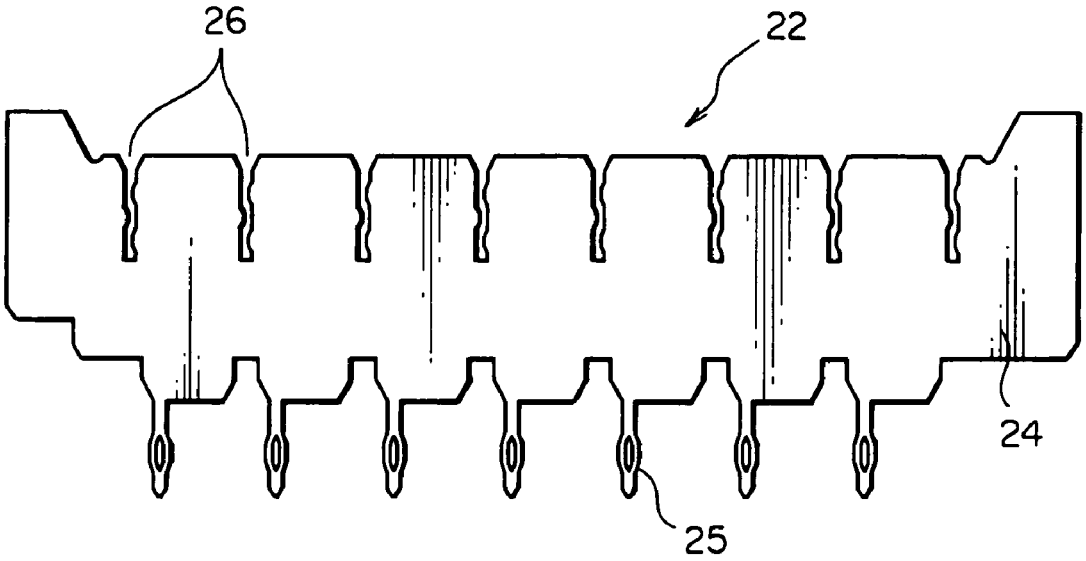
FIG. 3A is a front view of a vertical ground plate in a first half portion of the receptacle connector illustrated in FIG. 1.
Figure 3B:
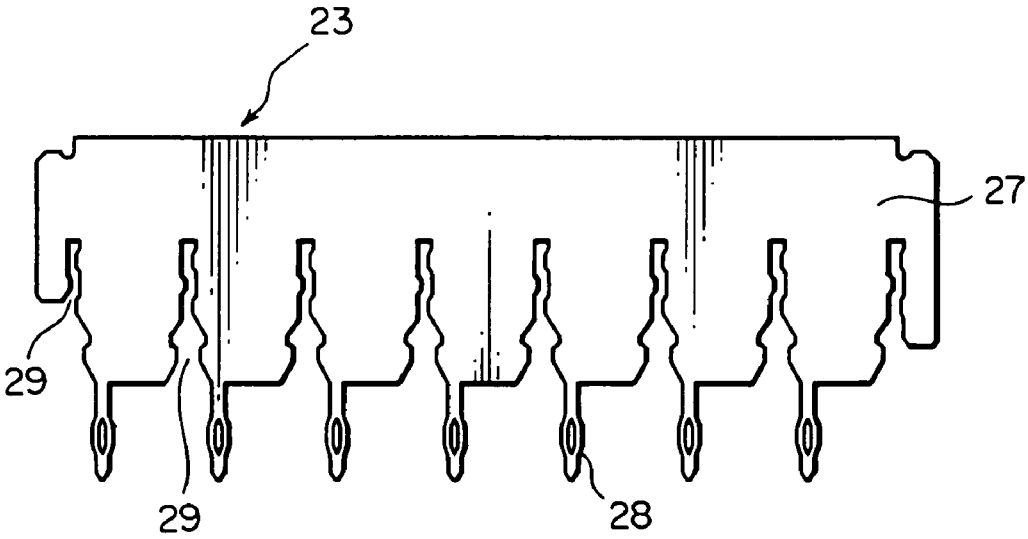
FIG. 3B is a front view of a horizontal ground plate in the first half portion of the receptacle connector illustrated in FIG. 1.

Referring to FIGS. 2, 3A, and 3B, the first half portion 14 of the receptacle connector 10 will be described.

The first half portion 14 comprises an insulating first housing 21 in the shape of a rectangular frame, several conductive vertical ground plates 22 held by the first housing 21 and placed in the vertical direction, and several conductive horizontal ground plates 23 held by the first housing 21 and placed in the horizontal direction.

Each of the vertical ground plates 22 has a plate portion 24 of a generally rectangular shape and several terminal portions 25 protruding from one long side of the plate portion 24. The plate portion 24 is provided with several grooves 26 formed on the other long side thereof.

Each of the horizontal ground plates 23 has a plate portion 27 of a generally rectangular shape and several terminal portions 28 protruding from one long side of the plate portion 27. Between adjacent ones of the terminal portions 28 and in the vicinity of leftmost and rightmost ones of the terminal portions 28, a plurality of grooves 29 are formed.

By inserting the horizontal ground plates 23 into the grooves 26 of the vertical ground plates 22 and inserting the vertical ground plates 22 into the grooves 29 of the horizontal ground plates 22, the vertical and the horizontal ground plates 22 and 23 are assembled and combined together to intersect with each other in the vertical and the horizontal directions in a lattice fashion. Thus, a combination of the vertical and the horizontal ground plates 22 and 23 in the first half portion 14 forms a first ground.

In the first half portion 14, the terminal portions 25 and 28 protrude from the first housing 21 towards the board 13. The terminal portions 25 and 28 are arranged in a first staggered pattern. The relationship between the board 13 and the terminal portions 25 and 28 will later be described.

Figure 4A:
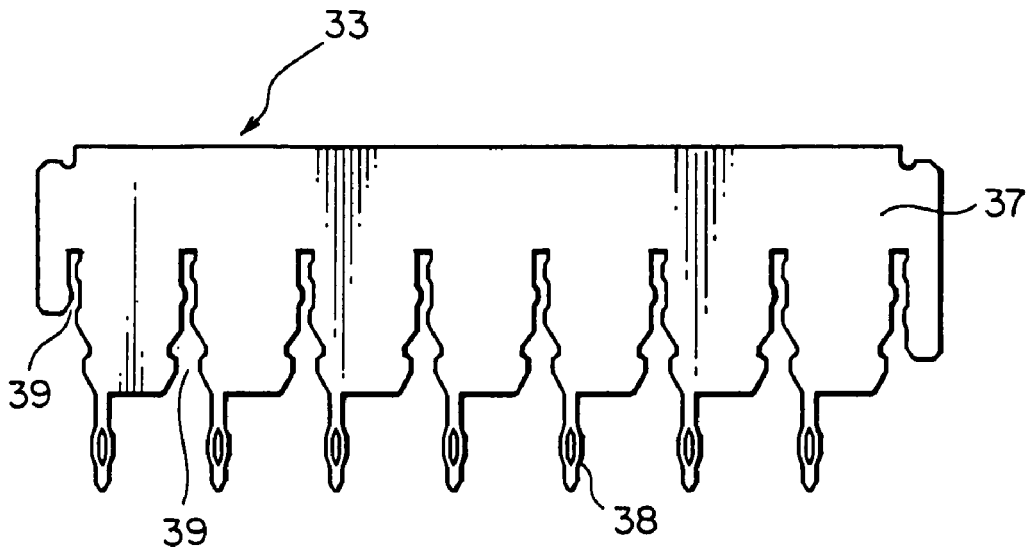
FIG. 4A is a front view of a horizontal ground plate in a second half portion of the receptacle connector illustrated in FIG. 1.
Figure 4B:
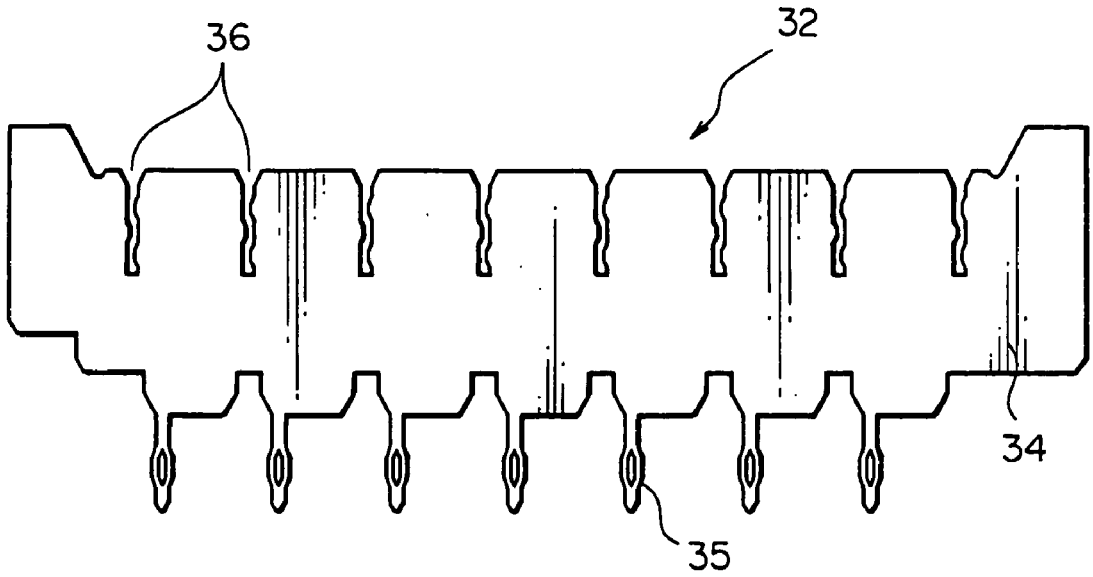
FIG. 4B is a front view of a vertical ground plate in the second half portion of the receptacle connector illustrated in FIG. 1.

Referring to FIGS. 1, 4A and 4B, the second half portion 15 of the receptacle connector 10 will be described.

The second half portion 15 is basically similar in structure to the first half portion 14. Specifically, the second half portion 15 comprises an insulating second housing 31 in the shape of a rectangular frame, several conductive horizontal ground plates 32 held by the second housing 31 and placed in the horizontal direction, and several conductive vertical ground plates 33 held by the second housing 31 and placed in the vertical direction.

Each of the horizontal ground plates 32 has a plate portion 34 of a generally rectangular shape and several terminal portions 35 protruding from one long side of the plate portion 34. The plate portion 34 is provided with several grooves 36 formed on the other long side thereof.

Each of the vertical ground plates 33 has a plate portion 37 of a generally rectangular shape and several terminal portions 38 protruding from one long side of the plate portion 37. Between adjacent ones of the terminal portions 38 and in the vicinity of leftmost and rightmost ones of the terminal portions 38, a plurality of grooves 39 are formed.

By inserting the vertical ground plates 33 into the grooves 36 of the horizontal ground plates 32 and inserting the horizontal ground plates 32 into the grooves 39 of the vertical ground plates 33, the horizontal and the vertical ground plates 32 and 33 are assembled and combined together to intersect with each other in the vertical and the horizontal directions in a lattice fashion. Thus, a combination of the horizontal and the vertical ground plates 32 and 33 in the second half portion 15 forms a second ground.

In the second half portion 15, the terminal portions 35 and 38 protrude from the second housing 31 towards the board 13. The terminal portions 35 and 38 are arranged in a second staggered pattern. The relationship between the board 13 and the terminal portions 35 and 38 will later be described.

Each of the signal contacts 16 has first and second contacting portions formed at opposite ends thereof and protruding from the first and the second housings 21 and 31, respectively. The first and the second contacting portions are surrounded by the first and the second grounds, respectively. With this structure, an electromagnetic shielding effect for the signal contacts 16 is obtained.

Figure 5:
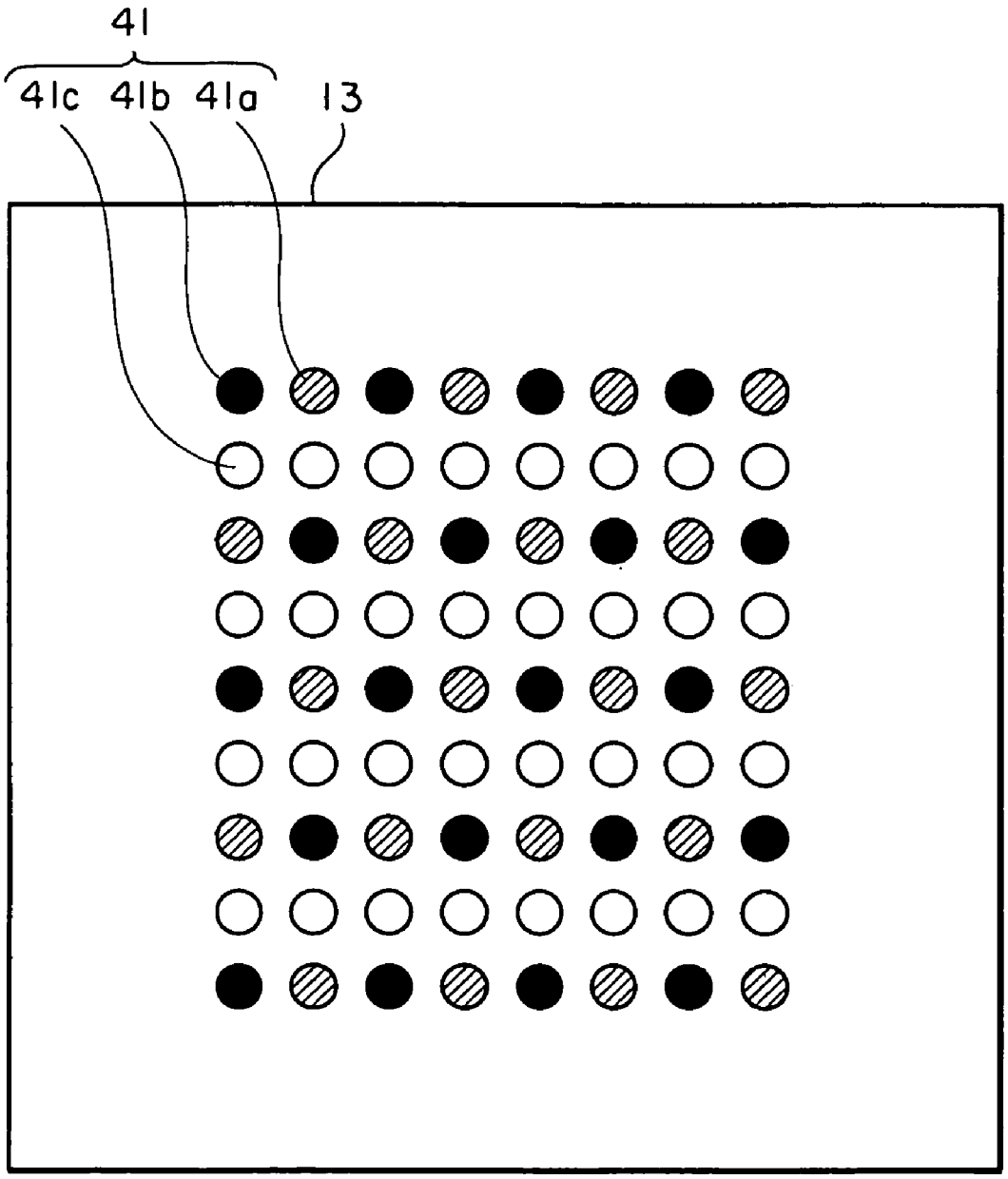
FIG. 5 is a schematic front view of the board illustrated in FIG. 1.

Referring to FIG. 5 in addition, description will be made of the relationship between the board 13 and the terminal portions 25 and 28 of the first ground and the relationship between the board 13 and the terminal portions 35 and 38 of the second ground.

The board 13 is provided with a number of through holes 41, schematically shown, in a matrix arrangement. In the figure, the through holes 41 are classified into hatched through holes 41*a*, black through holes 41*b*, and white through holes 41*c*. The terminal portions 25 and 28 arranged in the first staggered pattern in the first half portion 14 are press-fitted into the hatched through holes 41*a*, respectively. The terminal portions 35 and 38 arranged in the second staggered pattern in the second half portion 15 are press-fitted into the black through holes 41*b*, respectively. The signal contacts 16 are inserted into the white through holes 41*c*, respectively.

In the above-mentioned receptacle connector 10, the vertical and the horizontal ground plates 22 and 23 in the first half portion 14 are not brought into contact with the horizontal and the vertical ground plates 32 and 33 in the second half portion 15. Alternatively, these ground plates may be contacted with each other.

Next, various modifications will be described.

Figure 6:
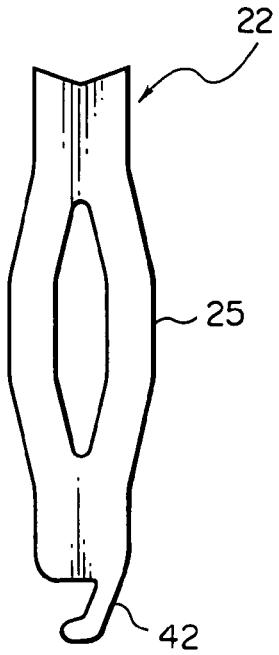
FIG. 6 is a front view of a characteristic part of a first modification of the ground plate.

Referring to FIG. 6, each of the terminal portions 25 of the vertical ground plate 22 may be provided with a hook-like spring portion 42. In this event, when each of the terminal portions 25 is press-fitted into the through hole 41 of the board 13, the spring portion 42 is elastically deformed and brought into press contact with an end face of the vertical ground plate 33 in the second half portion 15. Accordingly, the electromagnetic shielding effect for the signal contacts 16 is improved. The spring portions 42 may be formed in at least one of the vertical ground plates 22 and 33 and the horizontal ground plates 23 and 32.

Figure 7:
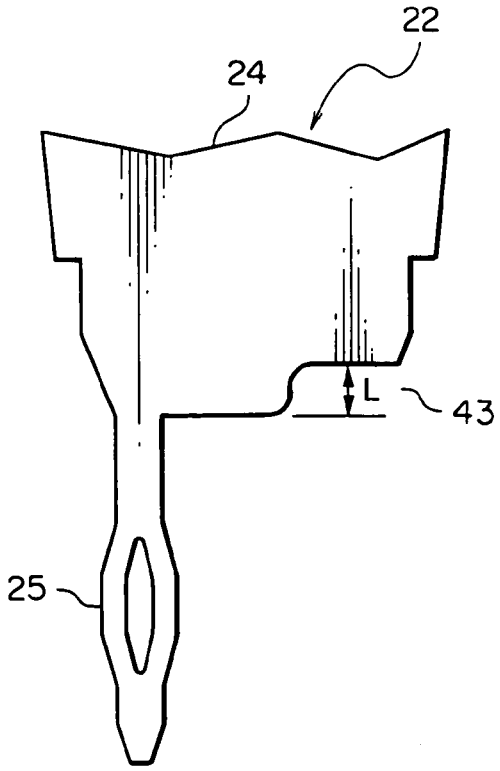
FIG. 7 is a front view of a characteristic part of a second modification of the ground plate.

Referring to FIG. 7, the plate portion 24 of the vertical ground plate 22 may be provided with a plurality of recesses 43 each of which has a depth L and each of which is formed at a position opposite to a base of each of the terminal portions 25. In this case, an end of each of the terminal portions 38 of the vertical ground plate 33 in the second half portion 15 is allowed to enter into the recess 43. Therefore, the board 13 can be reduced in thickness by twice the depth L. Preferably, the recesses 43 are formed in all of the vertical ground plates 22 and 33 and the horizontal ground plates 23 and 32.

Figure 8:
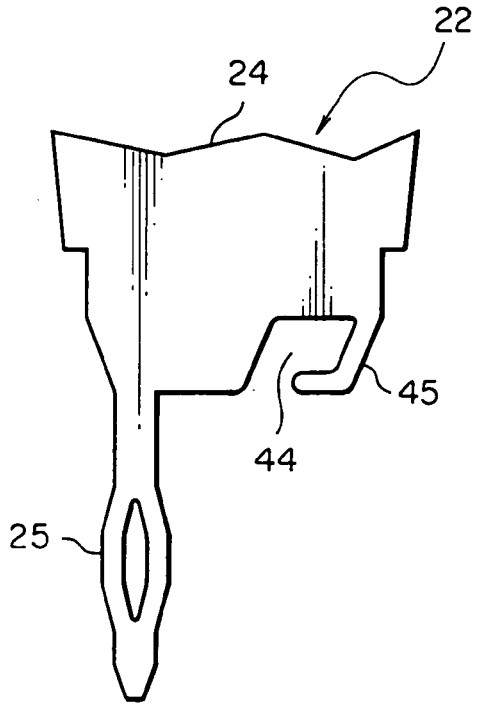
FIG. 8 is a front view of a characteristic part of a third modification of the ground plate.

Referring to FIG. 8, the plate portion 24 of the vertical ground plate 22 may be provided with a plurality of recesses 44 each of which has a slope, and a plurality of spring portions 45. Each of the recesses 44 and each of the spring portions 45 are formed at a position opposite to the base of each of the terminal portions 25. In this case, the board 13 is reduced in thickness. In addition, an end of each of the terminal portions 35 of the horizontal ground plate 32 in the second half portion 15 is guided along the slope of the recess 44 and is brought into press contact with the spring portion 45. Therefore, the electromagnetic shielding effect for the signal contacts 16 is improved. Preferably, the recesses 44 and the spring portions 45 are formed in all of the vertical ground plates 22 and 33 and the horizontal ground plates 23 and 32.

Figure 9:
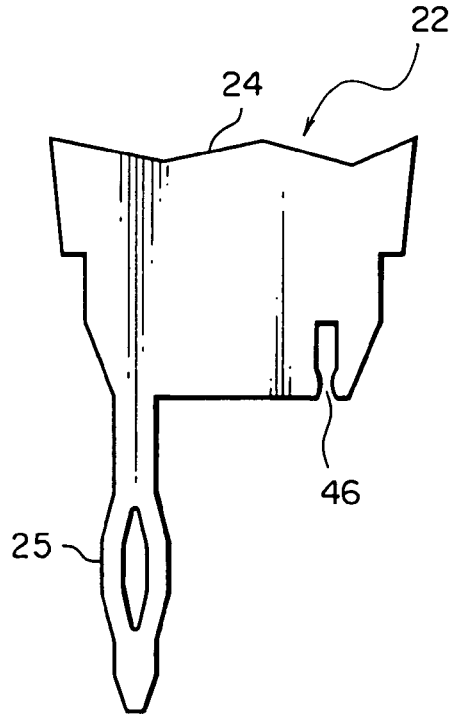
FIG. 9 is a front view of a characteristic part of a fourth modification of the ground plate.

Referring to FIG. 9, the plate portion 24 of the vertical ground plate 22 may be provided with a plurality of slits 46 each of which is formed at a position opposite to the base of each of the terminal portions 25. The slit 46 has an entrance narrower in width than an inner portion thereof. In this case, the board 13 is reduced in thickness. In addition, the end of each of the terminal portions 35 of the horizontal ground plate 32 in the second half portion 15 is inserted into the slit 46 in press contact with edges defining the slit 46. Therefore, the electromagnetic shielding effect for the signal contacts 16 is improved. Preferably, the slits 46 are formed in all of the vertical ground plates 22 and 33 and the horizontal ground plates 23 and 32.

Although the present invention has been shown and described in conjunction with a few preferred embodiments or examples thereof, it should be understood by those skilled in the art that the present invention is not limited to the foregoing description but may be changed and modified in various other manners without departing from the spirit and scope of the present invention as set forth in the appended claims. Although the ground surrounds each single signal contact in the foregoing description, the ground may surround every two adjacent ones of the signal contacts in case where a differential signal is transmitted.

What is claimed is:

1. A connector adapted to be mounted to a board, the connector comprising:

an insulating housing disposed on one surface of the board;

a conductive contact held by the housing, the contact having a contacting portion protruding from the housing towards a side opposite to the board; and a conductive ground held by the housing and surrounding the contacting portion, the ground having a plurality of terminal portions protruding from the housing into the board and arranged in a staggered pattern; wherein the ground comprises a plurality of ground plates combined with one another in a lattice fashion, the terminal portions being formed on the ground plates.

2. The connector according to claim 1, wherein the board has a plurality of through holes, the terminal portions having press-fit portions press fitted into the through holes, respectively.

3. A connector mounted on a board having a number of through holes, the connector comprising:

an insulating first housing disposed on one surface of the board;

an insulating second housing disposed on the other surface of the board opposite to the one surface;

a conductive contact inserted through each of the through holes, respectively, and held by the first and the second housings, the contact having first and second contacting portions which are formed at opposite ends of the contact and protrude from the first and the second housings, respectively;

a conductive first ground held by the first housing and surrounding the first contacting portion; and a conductive second ground held by the second housing and surrounding the second contacting portion, the first ground having a plurality of terminal portions protruding from the first housing towards the board and arranged in a first staggered pattern, the second ground having a plurality of terminal portions protruding from the second housing towards the board and arranged in a second staggered pattern, the terminal portions being inserted into the through holes, respectively.

4. The connector according to claim 3, wherein each of the first and the second grounds has a plurality of ground plates combined with one another in a lattice fashion, the terminal portions being formed on the ground plates.

5. The connector according to claim 3, wherein the terminal portions have press-fit portions press-fitted into the through holes, respectively.

6. The connector according to claim 3, wherein the first ground has a spring portion contacted with the second ground.

7. The connector according to claim 6, wherein the second ground has a spring portion contacted with the first ground.

8. The connector according to claim 3, wherein the first ground has a plurality of recesses faced to the terminal portions of the second ground, respectively.

9. The connector according to claim 8, wherein the second ground has a plurality of recesses faced to the terminal portions of the first ground, respectively.

10. The connector according to claim 3, wherein the through holes are arranged in a matrix pattern, the first and the second staggered patterns are symmetrical with each other.

11. A ground structure of a connector to be mounted to a board, the connector having a first half portion mounted on a first surface of the board and a second half portion mounted on a second surface of the board opposite to the first surface, the first half portion being adapted to be engaged with and disengaged from a first mating connector, the second half portion being adapted to be engaged with and disengaged from a second mating connector, each of the first and the second half portions comprising:

a housing;

a plurality of vertical ground plates held by the housing; and a plurality of horizontal ground plates held by the housing and intersecting with the vertical ground plates in a lattice fashion, the vertical and the horizontal ground plates having a plurality of terminal portions press-fitted into a plurality of through holes formed on the boards to be arranged in a staggered pattern, the first and the second half portions being provided with a plurality of signal contacts inserted through a plurality of through holes formed on the board, at least a part of the signal contacts being surrounded by the ground plates.

12. The ground structure according to claim 11, wherein a plurality of spring portions are formed at front ends of the terminal portions of the ground plates in the first and the second half portions or formed on plate portions of the ground plates, the spring portions of one of the first and the second half portions being brought into contact with the ground plates or the front ends of the terminal portions in the other of the first and the second half portions.

13. The ground structure according to claim 11, wherein the ground plates in the first and the second half portions are provided with a plurality of recesses so that front ends of the terminal portions of one of the first and the second half portions enter into the recesses of the other of the first and the second half portions.

* * * * *